United States Patent [19]

Nakayama

[11] 4,449,241

[45] May 15, 1984

[54] TONER CLEANING APPARATUS

[75] Inventor: Shigeru Nakayama, Hachioji, Japan

[73] Assignee: Olympus Optical Company Limited, Tokyo, Japan

[21] Appl. No.: 382,608

[22] Filed: May 27, 1982

[30] Foreign Application Priority Data

May 30, 1981 [JP] Japan ..... 56-78310[U]

[51] Int. Cl.[3] ..... G03G 21/00

[52] U.S. Cl. ..... 118/699; 15/256.52; 15/256.53; 118/652; 118/706; 355/15

[58] Field of Search ..... 118/652, 699, 706; 355/15; 430/125; 15/256.52, 256.53

[56] References Cited

U.S. PATENT DOCUMENTS

| | | | |
|---|---|---|---|
| 3,741,157 | 6/1973 | Krause | 118/652 |
| 3,759,220 | 9/1973 | Saito et al. | 430/125 X |
| 3,792,925 | 2/1974 | Milligan et al. | 15/256.52 X |
| 4,026,701 | 5/1977 | Till et al. | 430/125 |
| 4,279,501 | 7/1981 | Kojima et al. | 15/256.52 X |
| 4,364,660 | 12/1982 | Oda | 355/15 |

*Primary Examiner*—Evan K. Lawrence

*Attorney, Agent, or Firm*—Fleit, Jacobson, Cohn & Price

[57] ABSTRACT

A toner cleaning apparatus for use in an electrophotographic copying machine in which a photosensitive drum is rotated for a few revolutions after transferring, onto a record paper, a toner image obtained by developing an electrostatic latent image with toners, in order to remove residual toners from the drum and to prepare the drum for the next duplicating operation. A cleaning device, such as a fur brush, is arranged movably with respect to the photosensitive drum and is separated from the drum after the end of a copying operation, but before the drum is stopped. The cleaning fur brush is removed from the drum at such a timing that the pictorial area on the drum surface has just passed through the cleaning fur brush and thus, residual toners on the drum can be effectively removed. By shortening the time duration in which the cleaning fur brush is brought into contact with the photosensitive drum, the drum can be protected against injury, deterioration and filming.

12 Claims, 11 Drawing Figures

TONER CLEANING APPARATUS

BACKGROUND OF THE INVENTION

The present invention relates to a toner cleaning apparatus for removing unnecessary toners that remain on a photosensitive drum after transferring a toner image onto a copying paper.

Usually in an electrophotographic copying machine, in order to discharge positively a duplicated copying paper from the copying machine or to prepare the machine for an immediately succeeding copying operation, the photosensitive drum continues to rotate for a few revolutions after the completion of the copying operation.

In this case, a cleaning means such as a rotating fur brush or a cleaning blade arranged for cleaning unnecessary toners that remain on the photosensitive drum after transferring is brought into contact with the photosensitive drum, always regardless of whether the copying operation is effected or not, or until the rotation of the photosensitive drum is stopped Therefore, the time interval during which the photosensitive drum is in contact with the cleaning means becomes unnecessarily long, so that in the case of using a cleaning blade as the cleaning means the surface of the photosensitive drum is liable to be injured or damaged and thus, deterioration of the photosensitive drum increases. Moreover, in a fur brush cleaning device, a so-called filming phenomenon might occur. That is to say, fine particles of the toner material or fibres of the fur brush are liable to be coated on the surface of the photosensitive drum as a thin film due to heat generated by friction between the photosensitive drum and the fur brush. Further, when the photosensitive drum is made of glass-like selenium, crystallization of selenium can result, and therefore, the deterioration of the photosensitive drum increases.

SUMMARY OF THE INVENTION

The present invention has for its object to provide a novel and useful toner cleaning apparatus which eliminates the aforementioned drawbacks of the known toner cleaning apparatus and has a comparatively simple construction.

According to the invention, a toner cleaning apparatus for use in an electrophotographic copying machine in which a photosensitive drum is rotated after the end of the copying operation for a predetermined number of revolutions to remove residual toners remaining on said drum after transferring onto a record paper a toner image obtained by developing with toners an electrostatic latent image formed on the photosensitive drum within a pictorial area, comprises cleaning means arranged movably between a first position in which the cleaning means is separated from the photosensitive drum and a second position in which the cleaning means is brought into contact with the photosensitive drum to remove the residual toners;

driving means for moving the cleaning means between said first and second positions; and controlling means for controlling said driving means in such a manner that the cleaning means is separated from said photosensitive drum at a time after the end of the copying operation, but before the rotation of the photosensitive drum is stopped.

BRIEF DESCRIPTION OF THE DRAWINGS

FIGS. 6A to 6F are timing charts explaining the operation of the circuits shown in FIGS. 4 and 5.

DESCRIPTION OF THE PREFERRED EMBODIMENTS

Figure 1:
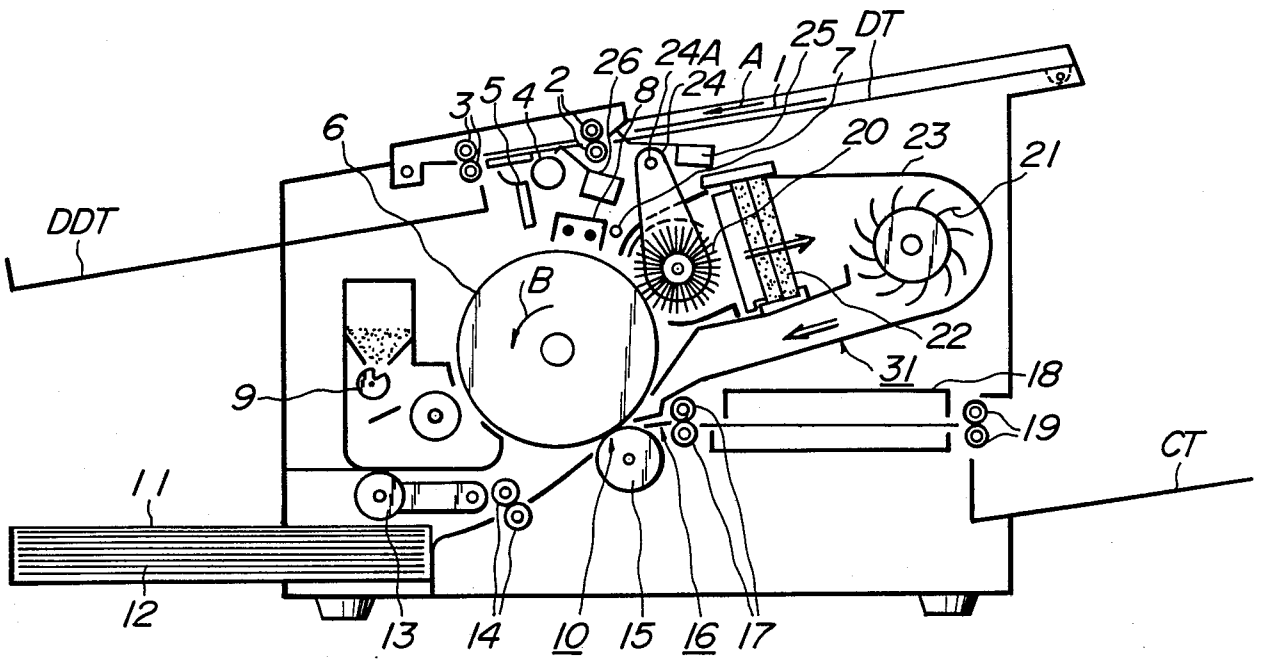
FIG. 1 is a cross-sectional view showing schematically a known electrophotographic copying machine to which the present invention can be advantageously applied.

FIG. 1 is a schematic view showing an embodiment of a known electrophotographic copying machine previously proposed by the assignee to which the present application is assigned. When a sheet like document 1 is placed on an inclined document table DT and is inserted into a document feed apparatus in a direction shown by an arrow A, the document is fed at a constant speed by means of feeding rollers 2 and 3 and is discharged on a document discharge table DDT. During this feeding the document 1 is illuminated by a lamp 4 and an image of the document is projected by means of an optical system 5 onto a rotating photosensitive drum 6. The drum 6 is rotated at a constant speed in the direction shown by arrow B. At first any residual charge on the drum surface is erased by an erasing lamp 7 and then the drum surface is uniformly charged by a corona charger 8. When the uniformly charged drum surface is subjected to the imagewise exposure, an electrostatic latent image is formed on the drum surface. Then the latent image is developed with toners by a developing device 9 of a magnetic brush type. Upon further rotation of the drum 6 the toned image is transported into a transfer section 10. Record papers 12 in a paper cassette 11 are picked up one-by-one by means of a swinging and rotating pick-up roller 13 and are successively supplied via register rollers 14 to the transfer section 10 in which the record paper 12 is fed between the drum 6 and a semiconductive transfer roller 15 to which a suitable transfer bias potential is applied and the toned image on the drum surface is transferred onto the record paper 12. In the transfer section 10 the record paper is intimately brought in contact with the drum surface. The record paper 12 is peeled off the drum 6 by means of a peeling claw and is fed into a fixing device 18 by means of a guide system 16 and feeding rollers 17. The toner image is fused onto the record paper to form a final hard copy which is discharged by discharge rollers 19 onto a copy tray CT. The toner image on the drum 6 is not wholly transferred onto the record paper, but a part thereof remains on the drum 6. The residual toner particles on the drum 6 are removed by a cleaning means such as a rotating cleaning brush 20 and the removed toner particles are sucked by a fan 21 and collected by a filter 22. In order to suck and collect the toner particles effectively the brush 20 and fan 21 are enclosed by a casing 23. In the present copying machine a plurality of copies can be formed from the same and single electrostatic charge image once formed on the drum 6 by repeating in succession the developing and transferring operations. During such a retention mode of printing, the cleaning operation is preferably omitted. For this purpose the cleaning brush 20 is arranged on an arm 24 journaled about a shaft 24A and during the retention mode of printing the cleaning brush 20 is separated from the drum 6. In the present embodiment an air stream produced by the cleaning fan 21 is conducted along a duct 31 the outlet of which opens at the transfer section 10 so as to blow an air stream in a space between the paper and the drum. Then the air stream serves to peel the record paper 12 from the drum surface. Further in order to initiate the operation of the copying machine and control various portions thereof in response to the insertion of the document into the document feed apparatus, a plurality of microswitches for detecting the document are provided (in the drawing the microswitches 25 and 26 are shown).

Figure 2:
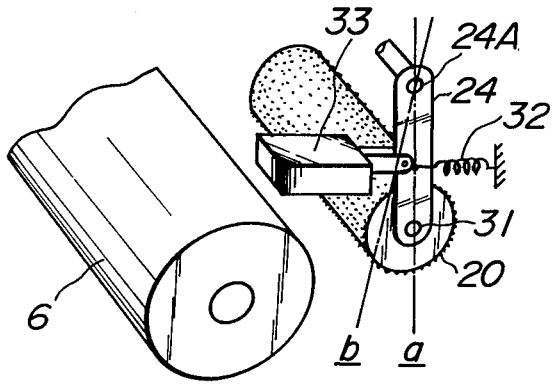
FIG. 2 is a fragmentary perspective view illustrating one embodiment of a cleaning apparatus according to the invention.

FIG. 2 is a fragmentary perspective view showing one embodiment of the cleaning apparatus according to the invention. In this embodiment, a fur brush is used as the cleaning means 20. The fur brush 20 is rotatably secured to one end of an arm 24 by means of a shaft 31 and is rotated by means of a motor not shown. The other end of the arm 24 is rotatably journaled to the main body of the copying machine about a shaft 24A. Moreover, between the arm 24 and the main body are arranged a solenoid 33 and a coiled spring 32 which pulls the cleaning brush 20 in such a direction that it is separated from the drum 6. During the cleaning operation the solenoid 33 is actuated to rotate the arm 24 twoard the drum 6 against the force of the spring 32, so that the fur brush 20 is brought into contact with the photosensitive drum 6. That is to say, during an interval in which the solenoid 33 is not energized, the fur brush 20 is located at a first position a in which the brush 20 is separated from the photosensitive drum 6, and if the solenoid 33 is energized, the fur brush 20 is moved into a second position b where the brush 20 is brought into contact with the photosensitive drum 6.

Figure 3:
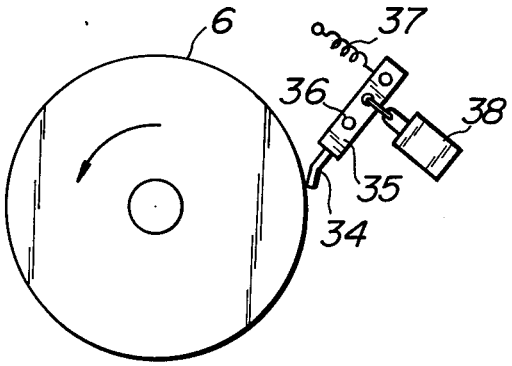
FIG. 3 is a schematic side view depicting another embodiment of the cleaning apparatus according to the invention.

FIG. 3 is a schematic side view showing another embodiment of the cleaning apparatus according to the invention which uses a cleaning blade 34 as the cleaning means. The cleaning blade 34 is made of elastic material such as urethane and is secured to a blade holder 35. The blade holder 35 is journaled swingably about a shaft 36. The blade holder 35 is biased by a coiled spring 37 in a direction such that the cleaning blade 34 is separated from the surface of the photosensitive drum 6. Further, a solenoid 38 is connected to the blade holder 35. During the cleaning operation, the solenoid 38 is energized to rotate the blade holder 35 in a clockwise direction about the shaft 36 against the force of the spring 37, so that the cleaning blade 34 is brought into contact with the surface of the photosensitive drum 6 under a certain pressure.

Figure 4:
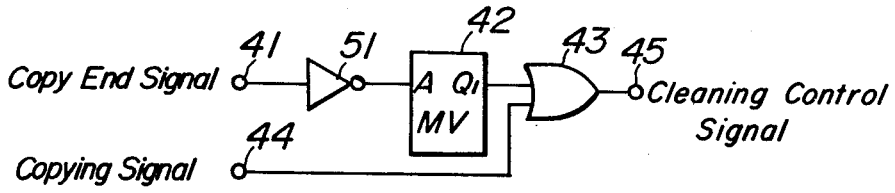
FIG. 4 is a circuit diagram showing one embodiment of a cleaning operation control circuit according to the invention.
Figure 5:
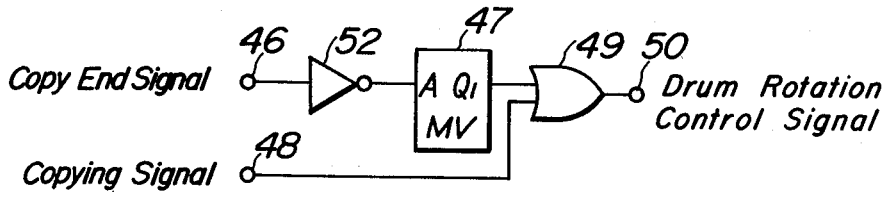
FIG. 5 is a circuit diagram illustrating one embodiment of a drum rotation control circuit according to the invention.
Figure 5:
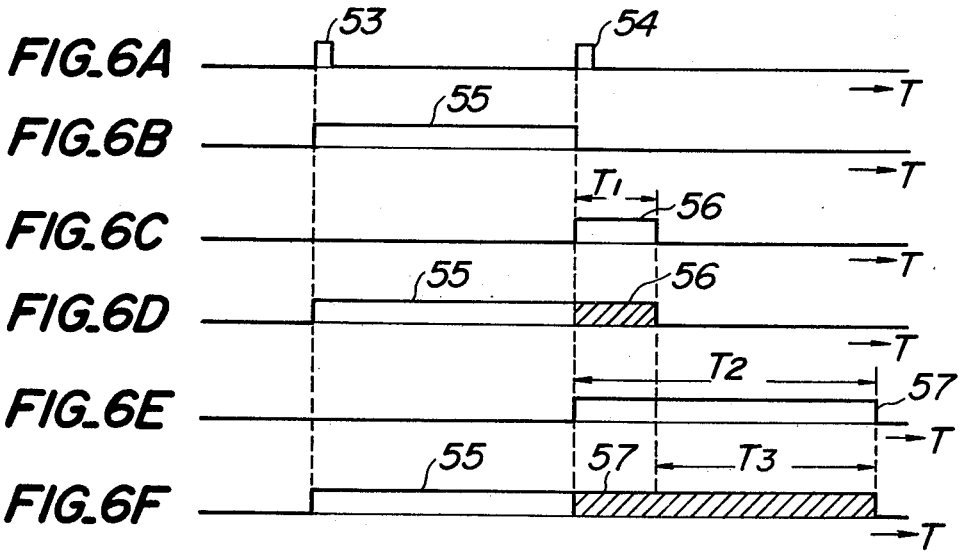

According to the invention, a cleaning operation control signal and a drum rotation control siganl generated from circuits shown by FIG. 4 and FIG. 5 are supplied to the cleaning means mentioned above and a motor for rotating the photosensitive drum, respectively, so as to effect the cleaning operation.

FIG. 4 shows an embodiment of the cleaning operation control circuit for producing the cleaning operation control signal. In FIG. 4, a monostable multivibrator 42 is actuated by a copy end signal which is received at a copy end signal input terminal 41 and is supplied to the multivibrator through an inverter 51. Then, there is generated a signal having a time period which is enough to remove the residual toners on the photosensitive drum after the copying operation. For example, this signal can have a duration which corresponds to one rotation of the drum. The signal thus generated is supplied to one input terminal of an OR gate 43. A copying signal representative of the copying operation is received at a copying signal input terminal 44 and is supplied to the other input terminal of the OR gate 43 so as to generate a logical sum of the signals mentioned above. In this manner, the cleaning operation control signal is derived from a cleaning operation control signal output terminal 45 to actuate the solenoids 33 and 38 of the cleaning means illustrated in FIGS. 2 and 3.

FIG. 5 shows an embodiment of a drum rotation control circuit for generating the drum rotation control signal for controlling a photosensitive drum driving motor. In FIG. 5, a monostable multivibrator 47 is actuated by the copy end signal received at a copy end signal input terminal 46 and supplied through an inverter 52. Then the multivibrator 47 produces an output signal having a duration corresponding to a time period during which the photosensitive drum rotates by a few revolutions. Such a rather long period is necessary to discharge a duplicated copying paper out of the copying machine. The output signal supplied from the monostable multivibrator 47 and the copying signal received at a copying signal input terminal 48 are supplied to an OR gate 49 to generate a logical sum signal as the drum rotation control signal at a drum rotation control signal output terminal 50. This drum rotation control signal is supplied to the motor for rotating the photosensitive drum.

FIGS. 6A to 6F are timing charts explaining the operation of the circuits shown in FIG. 4 and FIG. 5 As shown in FIG. 6A, a copy start signal 53 is generated each time when the sheet like document 1 is placed on the inclined document table DT and is inserted into the document feed apparatus in the direction shown by the arrow A as shown in FIG. 1. A copy end signal 54 is generated at the time that the photosensitive drum has rotated by one revolution after the copy start signal 53 was generated, when the copying machine is so constructed that a single copy is formed by one rotation of the drum. FIG. 6B depicts the copying signal 55 which lasts for a time period from the copy start signal 53 to the copy end signal 54. In the case of inserting a plurality of documents into the document feed apparatus successively within a very short interval, the copy start signal is generated every time the photosensitive drum rotates by one revolution, but the copy end signal is produced only once at a timing such that the photosensitive drum has rotated by one revolution after the last copy start signal is generated by inserting the last document into the document feed apparatus. Moreover, in case that n copies of the same document are formed from the same and single electrostatic latent image once formed on the photosensitive drum, the copy end signal is generated at a timing such that the photosensitive drum has rotated by n revolutions after the occurrance of the copy start signal. These copy start and end signals are already available in known copying machines, so that no special measure is required to generate these signals.

In FIG. 6C, a signal 56 is the output signal from the monostable multivibrator 42 shown in FIG. 4 and has a time period $T_1$ which is equal to or longer than the time required for removing the residual toners on the photosensitive drum. This signal is generated in response to the copy end signal. FIG. 6D shows the cleaning operation control signal derived from the OR gate 43 shown in FIG. 4. The cleaning operation control signal is composed of the copying signal 55 generated in response to the copy start signal 53 and the output signal 56 of the monostable multivibrator 42 having the time duration $T_1$. Generally the time duration $T_1$ may be set to a time during which the photosensitive drum rotates for just one rotation. But if, for example, the copying machine has such a function that a copying operation for A3 size can be performed by one rotation of the drum and that for A4 size needs only a half rotation, it is possible to set the duration $T_1$ to a time during which the drum rotates by a half revolution in the case of performing the copying operation for A4 size. In this manner, according to the invention, it is possible to set the duration $T_1$ to at least a time during which the residual toners on the photosensitive drum can be removed; i.e., an effective image area of the drum surface has passed through the cleaning means. Therefore, when the cleaning means is driven by the cleaning operation control signal thus obtained, the cleaning means is brought into contact with the photosensitive drum for a minimum time period for removing the residual toners from the drum and then is immediately separated from the drum.

FIGS. 6E and 6F illustrate the output signal of the monostable multivibrator 47 and the drum rotation control signal obtained from the OR gate 49, respectively. In FIG. 6E, the output signal 57 of the monostable multivibrator 47 is generated at the time of the copy end signal generation, and has a time duration $T_2$ during which the photosensitive drum is rotated by a few revolutions after the end of the copying operation in order to positively discharge the duplicated copy paper out of the copying machine and to prepare the next copying operation to be started immediately after the end of the previous copying operation. Therefore, as shown in FIG. 6F, the drum rotation control signal supplied from the OR gate 49 is obtained by deriving a logical sum of the output signal 57 of the monostable multivibrator 47 and the copying signal 55. Since the drum rotation control signal thus obtained lasts for the time duration $T_2$ after the end of the copying operation, it is possible to discharge the copy paper out of the copying machine without difficulty by continuously rotating the photosensitive drum in response to the drum rotation control signal. As clearly understood from FIGS. 6A to 6F, since the duration of the cleaning operation control signal shown in FIG. 6D is shorter than that of the drum rotation control signal illustrated in FIG. 6F by a time period $T_3$, the cleaning means can be separated from the photosensitive drum earlier than the known machine by the time period $T_3$.

As clearly seen from the embodiments mentioned above, according to the invention, since, in the electrophotographic copying machine which continues to rotate the photosensitive drum after the end of the copying operation, the cleaning means is brought into contact with the photosensitive drum only for the short time required for removing the residual toners on the drum after the end of the copying operation, it is possible to shorten the time during which the cleaning apparatus is kept in contact with the photosensitive drum and to extend the life of the drum as compared with the known cleaning apparatus wherein the cleaning means is always in contact with the photosensitive drum or the cleaning means is brought into contact with the drum as long as the drum rotates.

In the embodiment mentioned above, the present invention is explained in terms of an electrophotographic copying machine in which during the copying operation the cleaning means is always brought into contact with the photosensitive drum, but the present invention is not limited to be applied to the aforementioned copying machine. For instance, the present invention may be preferably applied to the retention type copying machine in which a plurality of copies can be obtained by a single exposure of a document image. In this case, the cleaning means may be brought into contact with the photosensitive drum just after the generation of the copy end signal for a certain duration $T_1$ during which the residual toners on the drum can be removed. Then, after the end of the duration $T_1$, the cleaning means may be separated from the photosensitive drum even if the drum continues to rotate as in the above explained embodiment.

What is claimed is:

1. A toner cleaning apparatus for use in an electrophotographic copying machine in which a photosensitive drum is rotated during a copying operation and continues to rotate after the end of the copying operation for a predetermined number of revolutions to remove residual toners remaining on said drum after transferring onto a record paper a toner image obtained by developing with toners an electrostatic latent image formed on the photosensitive drum within a pictorial area, said apparatus comprising:

cleaning means arranged movably between a first position in which the cleaning means is separated from the photosensitive drum and a second position in which the cleaning means is brought into contact with the photosensitive drum to remove the residual toners;

driving means for moving the cleaning means between said first and second positions; and controlling means for controlling said driving means in such a manner that the cleaning means is separated from said photosensitive drum as a time after the end of the copying operation, but before the rotation of the photosensitive drum is stopped.

2. An apparatus according to claim 1, wherein said time for separating the cleaning means from the photosensitive drum is the time at which the photosensitive drum has rotated just by one revolution after the end of the copying operation.

3. An apparatus according to claim 1, wherein said time for separating the cleaning means from the photosensitive drum is the time at which the drum has rotated by a fraction of one revolution after the end of the copying operation.

4. An apparatus according to claim 3, wherein said time for separating the cleaning means from the photosensitive drum is the time at which the pictorial area on the photosensitive drum has been just cleaned by said cleaning means.

5. An apparatus according to claim 1, wherein said cleaning means comprises a fur brush.

6. An apparatus according to claim 1, wherein said cleaning means comprises a cleaning blade.

7. An apparatus according to claim 1, wherein said driving means comprises a solenoid and a coiled spring coupled with the cleaning means.

8. An apparatus according to claim 1, wherein said controlling means comprises a cleaning control circuit responsive to a copying signal representative of the copying operation and a copy end signal respresentative of the end of the copying operation to generate a cleaning control signal for setting the cleaning means in said second position, and a drum rotation control circuit responsive to said copying signal and said copy end signal to generate a drum rotation control signal for rotating the photosensitive drum, said cleaning control signal being terminated after the occurrence of the copy end signal, but before the termination of the drum rotation control signal.

9. An apparatus according to claim 8, wherein said cleaning control circuit comprises a first input terminal for receiving the copy end signal, an inverter having an input connected to the first input terminal, a monostable multivibrator having an input connected to an output of the inverter, a second input terminal for receiving the copying signal, and an OR gate having inputs connected to an output of the multivibrator and said second input terminal, respectively, and an output for producing the cleaning control signal.

10. An apparatus according to claim 9, wherein said drum rotation control circuit comprises a first input terminal for receiving the copy end signal, an inverter having an input connected to the first input terminal, a monostable multivibrator having an input connected to an output of the inverter, a second input terminal for receiving the copying signal and an OR gate having inputs connected to an output of the multivibrator and said second input terminal, respectively, and an output for producing the drum rotation control signal, and said monostable multivibrator provided in the cleaning control circuit has an operation time which is shorter than that of the monostable multivibrator provided in the drum rotation control circuit.

11. An apparatus according to claim 1, wherein said controlling means controls the driving means in such a manner that the cleaning means is brought into contact with the photosensitive drum in response to the start of the copying operation.

12. An apparatus according to claim 1, wherein said controlling means controls the driving means in such a manner that said cleaning means is brought into contact with the photosensitive drum in response to the end of the copying operation.

* * * * *